United States Patent [19]

Cross

[11] Patent Number: 4,692,974

[45] Date of Patent: Sep. 15, 1987

[54] CONNECTOR BLOCK FOR USE WITH A ROBOTIC WIRE HARNESS ASSEMBLY SYSTEM

[75] Inventor: Dan A. Cross, Seattle, Wash.

[73] Assignee: The Boeing Company, Seattle, Wash.

[21] Appl. No.: 798,828

[22] Filed: Nov. 18, 1985

Related U.S. Application Data

[63] Continuation-in-part of Ser. No. 741,318, Jun. 4, 1985.

[51] Int. Cl.[4] ..... H01R 43/00

[52] U.S. Cl. ..... 29/33 M; 29/747; 29/755; 29/760; 29/845; 269/69; 269/903; 409/221; 279/5

[58] Field of Search ..... 29/33 K, 33 M, 742, 29/745, 747, 755, 759, 760, 854, 857, 845; 409/221, 224; 279/5; 269/47, 50, 52, 69, 903

[56] References Cited

U.S. PATENT DOCUMENTS

| | | | |
|---|---|---|---|
| 2,520,518 | 8/1950 | Thompson | 279/5 |
| 2,701,432 | 2/1955 | Kent | 279/5 |
| 3,075,411 | 1/1963 | Adise et al. | 409/221 |
| 3,090,633 | 5/1963 | Farnsworth | 279/5 |
| 4,433,476 | 2/1984 | Bailey et al. | 29/760 |
| 4,520,966 | 6/1985 | Block et al. | 279/114 |

*Primary Examiner*—Gil Weidenfeld
*Assistant Examiner*—Daniel W. Howell
*Attorney, Agent, or Firm*—Christensen, O'Connor, Johnson & Kindness

[57] ABSTRACT

Disclosed is a connector block used for placing an electrical connector in precise position for receiving the ends of wire segments that are inserted therein by a robotic device. The connector block includes a socket upon which the connector is supported. The socket (hence the supported connector) can be selectively positioned in a plurality of positions relative to the robotic device. The connector block also includes a lock pin for both securing the socket in position and for providing a readily detectable indication of which particular rotational orientation in which the socket is disposed. The connector block also includes a reference pin usable for establishing the particular orientation of the connector block relative to the form board.

18 Claims, 8 Drawing Figures

CONNECTOR BLOCK FOR USE WITH A ROBOTIC WIRE HARNESS ASSEMBLY SYSTEM

The United States Government has rights in this invention pursuant to Contract No. DAAH01-82-D-0013 awarded by the U.S. Army.

RELATED APPLICATIONS

This application is a continuation-in-part of an application filed June 4, 1985, Ser. No. 741,318, entitled Robotic Wire Harness Assembly System.

FIELD OF THE INVENTION

This invention relates to a connector block used to hold an electrical connector in a predetermined position for receiving the ends of wire segments that are inserted into the connector by a robot.

BACKGROUND OF THE INVENTION

A wire harness is a bundle of wires that can be handled as an element and can be easily installed to interconnect components of various electrical and electronic systems. The shape of a wire harness is dictated by the environment for the harness and the particular location of connections for the harness. Accordingly, a wire harness often includes one or more bends and branches for routing various wire segments of the harness to their corresponding connection points.

A harness often includes 50 or more wires, each uniquely terminated and uniquely positioned. It is important that each wire extend from a predetermined position on one connector to the corresponding position on a second connector or other terminal device. Bends must be formed into each wire during lay up.

When done manually, the wires are cut to length after being inserted into the originating connectors and being laid up in the necessary path. Each wire must be identified so that the technician can place the correct wire in the correct contact of the connector. Even for simple harnesses, the task is Herculean, making the manual assembly of wire harnesses extremely labor intensive.

Robotics in manufacturing has recently lead to reearch and development of robotic systems for assembling wire harnesses. To achieve robotized assembly, special tools for handling the wire had to be developed, since the lengths of wire were difficult to handle without some precise control. While robots can more in predefined paths, they are not intelligent and cannot make even rather minor course corrections. Therefore, the tools necessarily had to be designed to overcome the variations that would undoubtedly occur so that the preciseness of the robot motion could still be utilized.

SUMMARY OF THE INVENTION

This invention is directed to a connector block that is configured to hold an electrical connector in a predetermined position for receiving the ends of wire segments that are inserted into the connector by a robotic device. The connector block includes a base that is attachable to a work surface, and a socket that is configured to mate with a number of conventional electrical connectors and is connected to the base in a predetermined, rotational orientation. The socket is rotatable so that a connector mounted in the socket is properly positioned (i.e., "clocked"). The connector block includes a lock pin, for securing the socket in a preselected position and for providing a reference identifying the rotational position of the socket and connector.

DETAILED DESCRIPTION

A. System Overview

Figure 1:
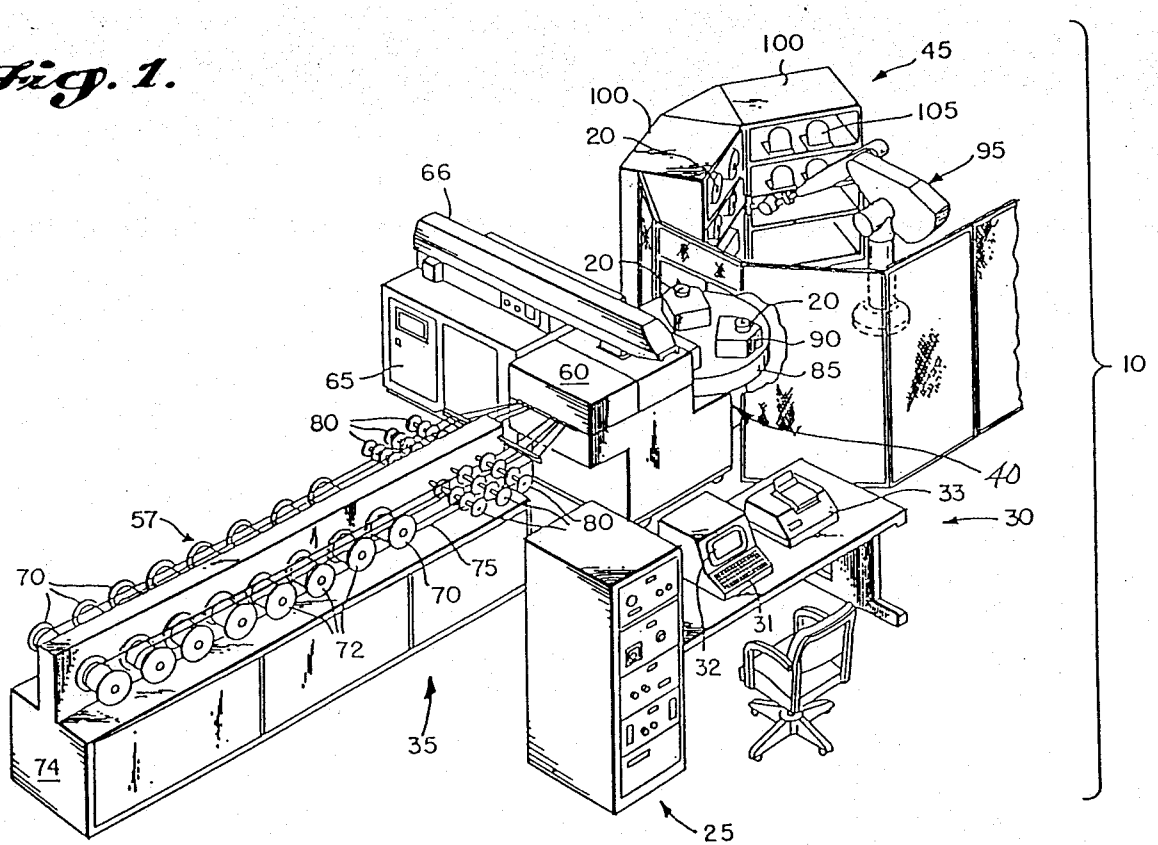
FIGS. 1 and 2 illustrate a robotic wire harness assembly system using the connector block of this invention.
Figure 2:
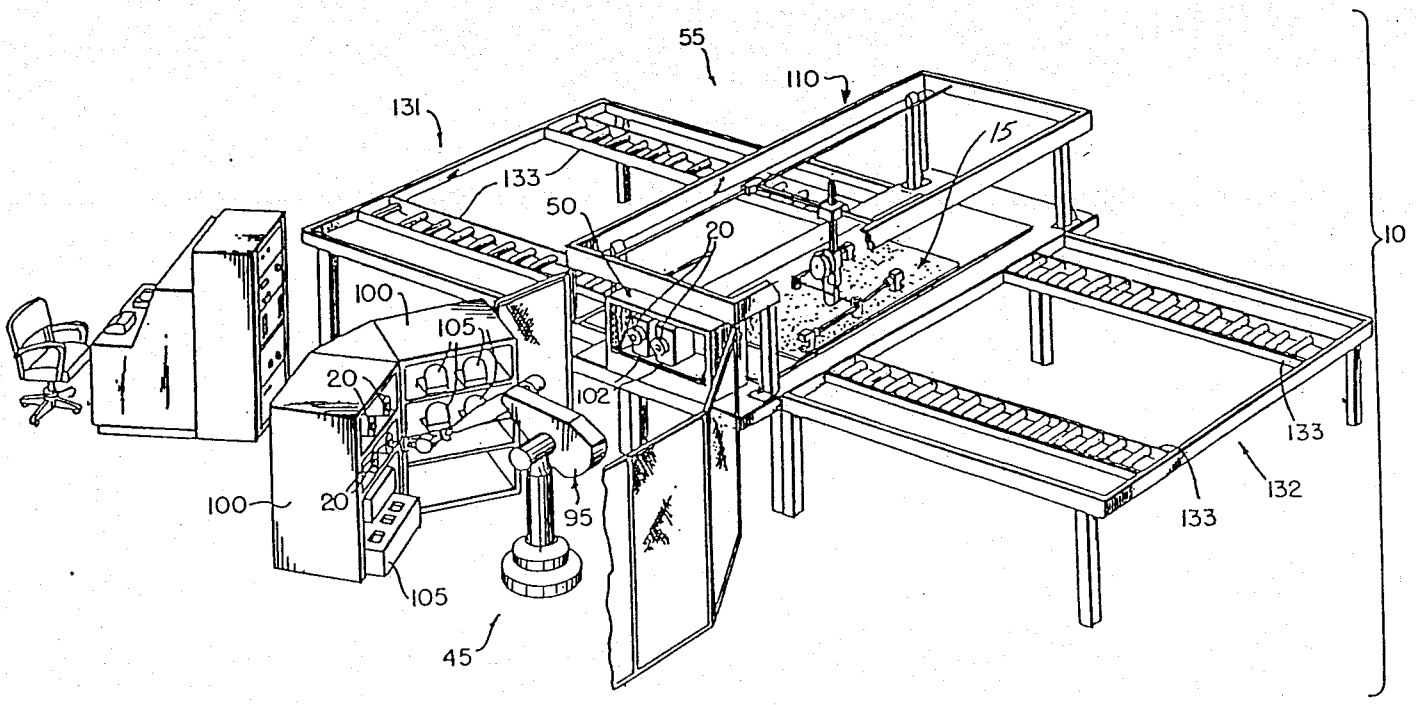

As shown in FIGS. 1 and 2, the system 10 is an integrated combination of hardware and software capable of performing the task of producing an electrical wire harness 15. Data necessary for controlling each subsystem of the system 10 is generated in an off-line CAD computer and is transmitted from the computer to a control system 30, which includes: a master system computer 25; data input devices (such as keyboard 31); and data output devices (such as a CRT 32 and printer 33). The system computer 25 supplies control signals to a wire preparation subsystem 35, a wire reeling subsystem 40, a wire termination subsystem 45, a wire queuing subsystem 50, and a wire layup subsystem 55, as described in U.S. Pat. No. 4,520,966 and U.S. patent application Ser. No. 741,318, herein incorporated by reference.

The master system computer 25, preferably an INTEL 86/380 segmented into six internal computers, converts input engineering data from an associated VAX data generator computer and keyboard 31 into processing commands required to operate the assembly system components in the several subsystems for assembly of a wire harness. The control commands are distributed to appropriate subsystem controllers (which command and monitor each step of the harness assembly process). The input and output devices included with the control system 30 allow the operator to communicate with the subsystems to directly control the sequence of activity in the system 10, to input additional commands manually, or to override the data generator input or master system computer.

The wire preparation subsystem 35 uses a commercial WESTLAND Laser Cable Marking System, to mark and cut wire segments. The system includes a wire de-reeling station 57, a marker/cutter unit 60, and a control computer not shown. Generally a slave to the master system computer, the WESTLAND control computer allows direct control of the subsystem, if desired. The wire de-reeling station 57 holds a plurality of wires of different dimensions on several, replaceable wire reels or spools 70, and allows selection of the desired wire by the marker/cutter unit 60. The spools 70 are journalled onto shafts 72 extending through the base 74 of the de-reeling station 57. Wires 75 are tensioned by a series of idler and tensioning pulleys 80 on the base 74 and are pulled to the marker/cutter 60 by a positive feed drive roller (not shown) in the unit 60.

The marker/cutter unit 60 also includes an alignment system for drawing a selected wire onto the drive rollers, a laser 66 of suitable power, and associated control and targeting equipment (not shown) to print identification markings on the wire. A guillotine blade actuator (not shown) cuts the continuous wire into wire segments. Each wire has a unique length. Specifically, for a plurality of wire segments in a wire harness extending between two end connectors, the length of each wire segment in the harness depends upon its location within the harness. For any particular wire harness assembled in accordance with this invention, input data describes the precise position that each wire segment will assume in the harness and the precise length of that wire. The wire preparation subsystem 35 selects, marks, measures, and cuts the wire 75 while feeding cut segments into the wire reeling subsystem 40.

In the wire reeling subsystem 40 each wire segment is wound into an individual wire canister 20 that can be easily handled by a robot during the remaining steps of the harness assembly.

The wire termination subsystem 45 includes a MERLIN robot 95, which swivels to pick up a loaded canister 20 from the wire reeling subsystem 40 and present either the leading end 76 or the trailing end 78 of the wire segment 77 to one or more of several termination devices 105, located in a rack 100, which terminate the ends of the wires. After both wire ends are properly terminated, the robot 95 places the canister 20 in a receiving bay 102 of the wire queuing subsystem 50, releases the canister, picks up an empty canister from an adjacent bay 102, and returns it to the wire reeling subsystem.

Figure 3:
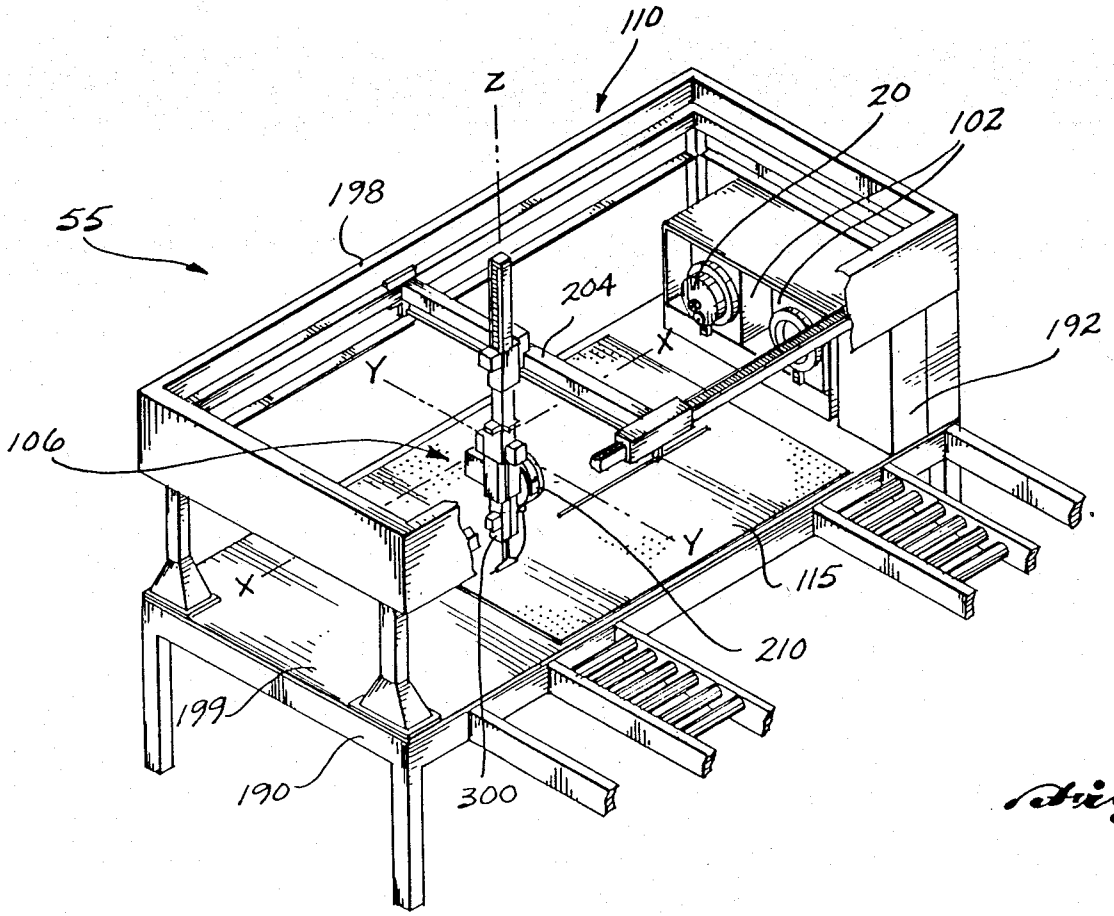
FIG. 3 is an isometric view of the wire queuing and wire layup subsystems of the harness assembly system.

The wire layup subsystem 55 (depicted in FIGS. 2 and 3) includes an IBM Model 7565 robot 110; a clamp 210, which carries a canister 20 during wire routing operations; and, a wire routing tool 300, which is connected with the layup robot 110.

The layup robot 110 includes a rectangular table 190, having a rectangular frame 198 supported above and parallel to the table's surface. Mounted between the oppositely disposed major sidewalls of the frame 198 is a beam 204 that can be driven along the length of the sidewalls in the x direction of a Cartesian coordinate system. Extending downwardly from the beam 204 is a manipulator arm 106 that can be driven along the length of the beam in the y direction. The manipulator arm 106 can also be rotated about its longitudinal axis (z axis in FIG. 3) and can be moved upwardly and downwardly.

Figure 4:
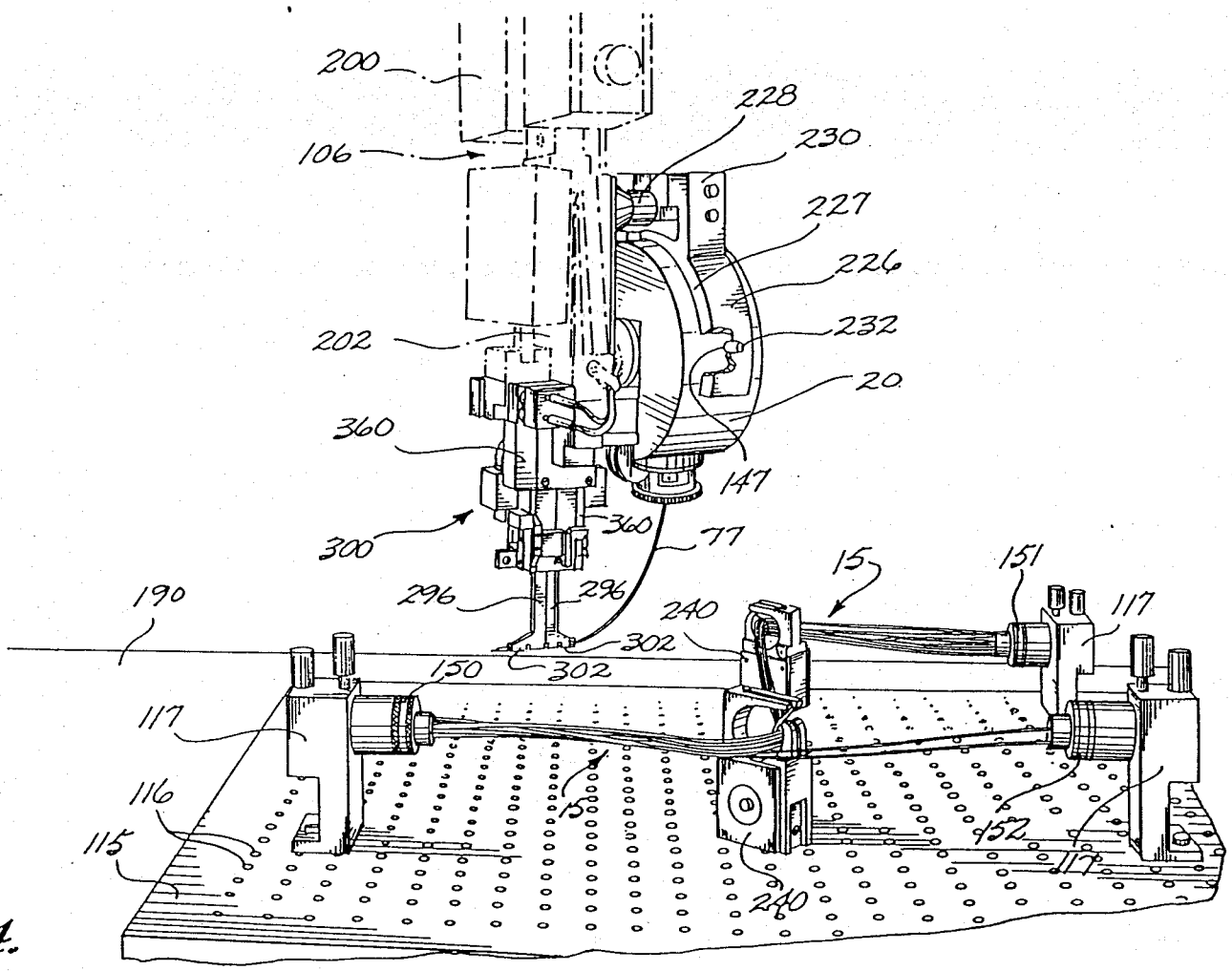
FIG. 4 is an isometric view of the manipulator arm of the layup robot positioned over a form board.
Figure 5:
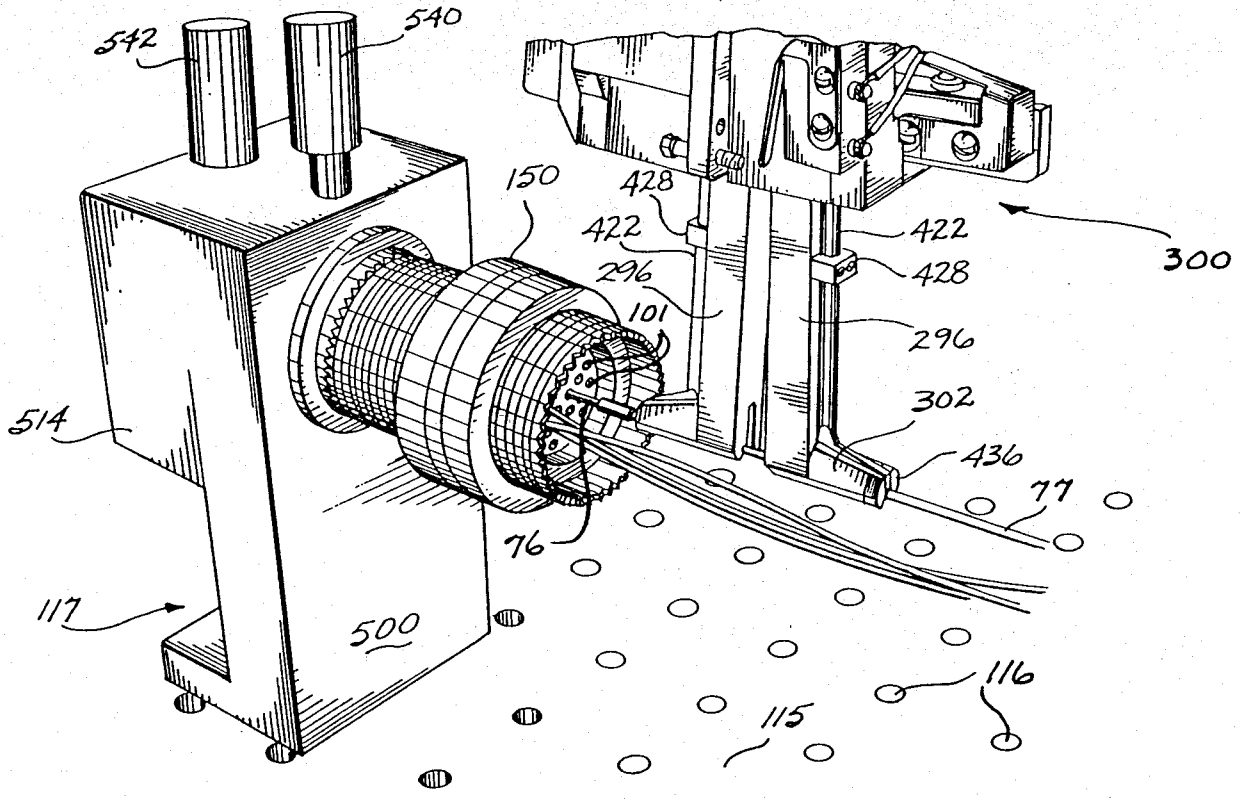
FIG. 5 is an isometric view showing a tool inserting the end of a wire segment into an end connector supported by a connector block of this invention.
Figure 6:
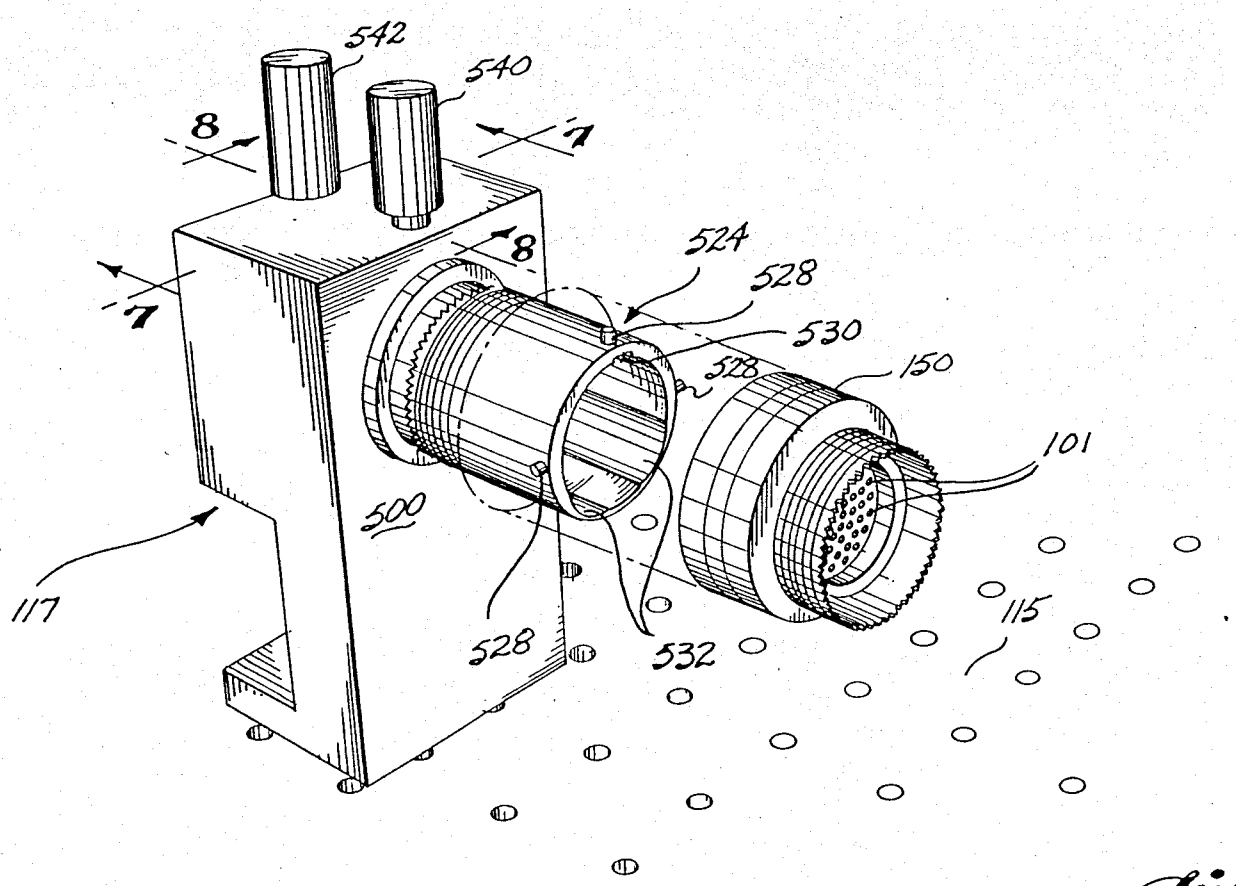
FIG. 6 is another isometric view of the connector block of FIG. 5.

As is best shown in FIG. 4, a wire layup tool 300 is attached to a jaw unit 202 depending from the main member 200 of the manipulator arm 106.

The tool 300 includes two substantially identical legs 296 that extend downwardly from a housing 360, which is mounted to the jaw unit 202. Each leg 296 is pivotally mounted within the housing 360 and the legs 296 can be independently swung about pivot points to move the lower end of that leg toward or away from the other leg. Integrally formed in the lower end of each leg 296 is an outwardly extending foot 302 that includes a downwardly facing groove 344 that serves as a wire-guide. When the legs 296 are swung together (FIG. 4), the feet 302 and grooves are aligned. Each foot 302 can independently grasp (clamp) a wire that passes through the groove of that foot or can allow the wire to pass freely within the groove.

To construct a wire harness 15 with wire layup subsystem 55, a rectangular form board 115 that includes a rectangular array of spaced holes 116 is placed on the top work surface of table 190 for access by the tool 300. Connectors 150, 151 and 152 for the wire harness are mounted within connector blocks 117 of the present invention that are positioned on the form board 115. Turn gates 240, which allow bends to be formed in the wire harness even with precut wires, are also installed in the holes 116 of form board 115. The connector blocks 117 precisely position each connector in the harness. The robot 110 picks up a canister 20 that contains a wire segment 77 from one of the receiving bays 102, by holding the wire in the grooves formed in the feet 302 of tool 300. The robot inserts one end of the wire segment 77 into a receptacle of a connector, moves the tool 300 along a predetermined path to dispense the wire segment 77 in the harness, and installs the second end of the wire segment into a second connector, before returning the empty canister 20 to the receiving bay 102. The process is repeated until the wire harness 15 is complete.

B. Connector Block

A connector includes a plurality of apertures 101 for receiving the terminals 76 of the wire segments 77. For the robot to properly insert the correct wire segment in its correct aperture, it must be apprised of the exact spatial position of all of the apertures in the connector relative to a given reference point. The form board 115, having a regular rectangular array of holes 116 formed therein, is used to define a plane in space. This is, the position of the form board is known by the layup robot. The connector block 117, having a known geometry is then positioned on the form board. The connector block carries an end connector and includes mechanisms for rotating the end connector into its proper clocking position that corresponds with the clocking of the mating system connector. If the connector block is properly positioned with respect to the form board and the connector is mounted to the connector block in a selected clocking position relative to the connector block, the robot can determine precisely where (in terms of X-Y-Z coordinates) each individual aperture is located in space.

The connector block of this invention includes mechanisms for permitting the robot to readily determine the location of the connector block relative to the form board, the clocking position of the mounted connector, hence, the spatial position of each of the apertures in the connector.

The connector block includes a base 500 that rests on the form board 115, a mounting flange 506 adjacent to the form board that includes at least one hole 508. When the hole 508 is aligned with a hole 510 in the form board a fastener 512, installed in the holes 508 and 510, precisely positions the block to the board.

The base 500 has an opening 514 formed therein. A cylindrical plug 516 is positioned within the opening 514. The plug 516 is rotatable within the opening 514. The plug 516 has a cavity 517 in one of its sides 519, and a boss 518 projecting from the other side 520. The boss 518 carries a socket 522 comprising a cylindrical shell 524. A flange 526 encircles the shell.

The outward end of the shell 524 includes pins 528 located at the nine, twelve and three o'clock positions. The pins 528 each receive a helical groove formed in the interior of a conventional connector thereby allowing the connector to be threaded onto the socket. The connector block is preferably sized to carry the connector approximately three inches above the form board. This height allows the tool to access the connector but does not interfere with the movement of the tool and manipulator arm above the form board.

The interior surface of the shell 524 includes a master keyway 530 that extends inwardly parallel with the axial centerline of the shell 524. Auxiliary keyways 532 are formed in its inner surface. The auxiliary keyways are relatively wide (as measured along the internal circumference of the cylinder wall) than the master keyway. The longitudinal centerlines of the auxiliary keyways 532 are oriented approximately 120° from the centerline of the master keyway 530. The socket 522, accordingly, will mate with most conventional connectors because the auxiliary keyways 532 formed in the socket 522 are wide enough that the auxiliary keys of most conventional connectors will fit within them.

Figure 8:
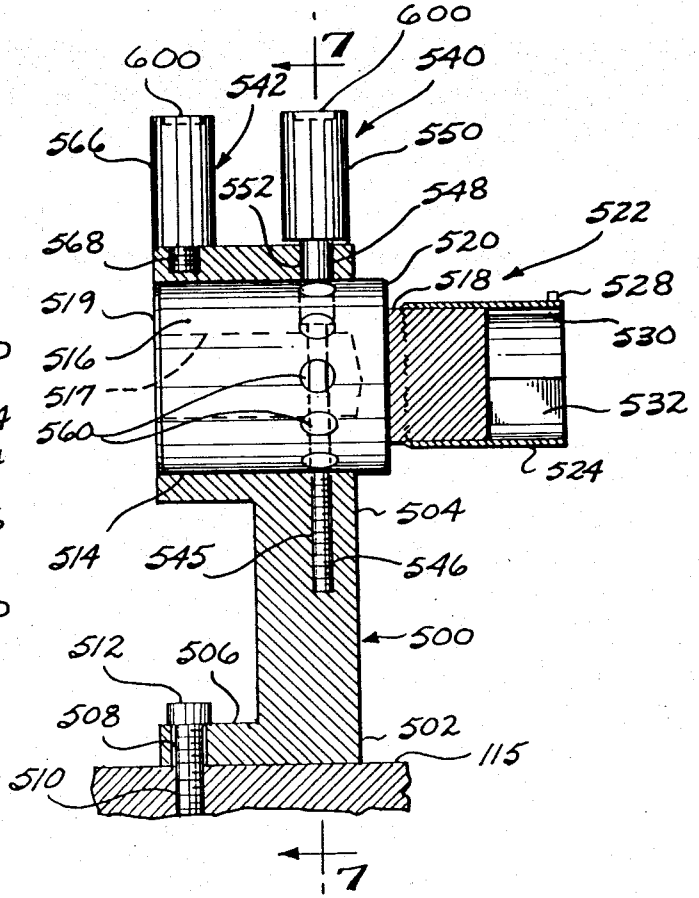
FIG. 8 is a side sectional view of the connector block taken generally along line 8—8 in FIG. 6.
Figure 7:
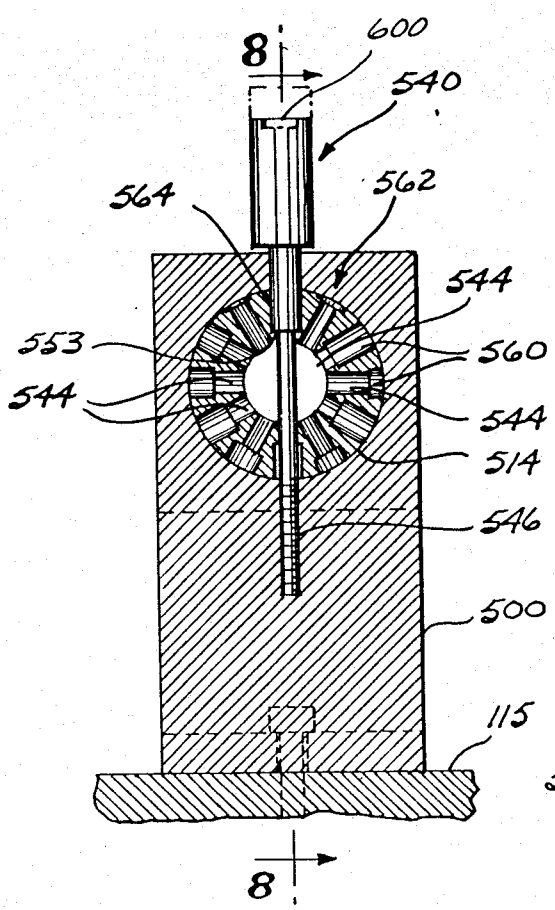
FIG. 7 is a front sectional view of a connector block taken generally along line 7—7 of FIG. 6.

The connector block allows the shell 524 to be oriented in any of twelve clocking positions. The plug 516 includes twelve radial bores 544 evenly spaced around the circumference of the plug in a common plane. The plug 516 (FIGS. 7 and 8) is maintained in a selected clocking position by a lock pin 540 that passes through a hole 552 in the counnector block, through aligned bores 544 of the plug 516, and into a hole 545 in the base 500. To allow the lock pin 540 to be easily inserted when the plug 516 is rotated to the desired clocking position, the lower end 546 of lock pin 540 is smaller in diameter than the bores 544. To precisely position plug 516 at the desired clock position, a portion 552 of the pin 540 fits snugly in counter bores 560 that extend along the outward portion og each bore 544.

The length of the pin 540 between the shoulder 553 (FIG. 7) of the thicker portion 552 of the pin and the reflecting material 600 is precisely machined to within about 0.001 inch, and the depth of the counterbores 560 are also bored precisely to twelve different depths.

The counterbores 560 are set at different depths so that the height of the head 550 above the block can be readily correlated to the clocking position of plug 516. Preferably, the counterbores are arranged so that no two relatively deep counterbores are adjacent. This arrangement allows counterbores of sufficient depth to be formed in the plug, and allows relatively large increments in the height of the plug above the block between adjacent clock positions so that it is relatively easy to determine that the clock position is appropriate. The layup robot 110 can determine that the correct clocking position has been selected before beginning the harness assembly by touching the head 550 with a proximity sensor on the manipulator arm. If the clocking position is incorrect an error will be signalled.

The connector block also includes a reference pin 542 having a head 566 and a stud 568 that is threaded into the connector block near the lock pin 542.

The lock pin 540 and the reference pin 542 are positioned so that their longitudinal centerlines define a plane that passes through the center of the socket 522. Knowing the spatial position of this plane, the layup robot 110 can determine whether the connector is properly positioned for layup of the preconfigured and precut wires. The top of the lock pin 540 and of the reference pin 542 are coated with reflective material 600. A optic sensor on the manipulator arm 106 detects the location of the lock pin 540 and reference pin 542, without actually touching the pins. High precision is achieved by a sensor on the robot actually touching each pin. The position of the pins in tha x-y-z space above the form board can then be determined to within a few one-thousandths of an inch in each direction.

While a preferred embodiment has been shown and described, those skilled in the art will recognize alterations, modifications and variations that might be made to these embodiments without departing from the inventive concept. Therefore, the claims should be interpreted liberally to protect the described embodiments and their reasonable equivalents. The description and drawings are meant to illustrate the invention and are meant to limit the invention only insofar as limitations are necessary in view of the pertinent prior art.

The embodiments of the invention in which an exclusive property or privilege is claimed are defined as follows:

1. A method for determining the precise position of a connector relative to a form board, wherein the connector is mounted to a socket, the socket being connected to a base that is fixed to the form board, the socket is rotatable into a plurality of positions relative to the form board, the socket is secured to one position by a locking pin, the locking pin assumes a particular predetermined position relative to the socket depending upon the position the socket is disposed, and the base also carries a reference pin wherein the reference pin and locking pin define a reference plane, the method including the steps of:

(a) determining the position of the form board;
(b) determining the position of the locking pin relative to the socket; and
(c) determining the position of the reference plane relative to the form board wherein the rotational orientation of apertures on the connector can be determined precisely from the measurements made.

2. A connector block for precisely positioning a connector in any one of a plurality of clocking positions relative to a work surface, comprising:

(a) a base positionable on the work surface;
(b) a socket for receiving the connector, the socket being connectable to the base in any one of a plurality of clocking positions;
(c) means for securing the socket in the selected position and,
(d) means for indicating to a robot the selected clocking position and the position of the base relative to the work surface.

3. A connector block for supporting an electrical connector in a precise, predetermined position accessible by a robot adjacent to a work surface, comprising:

(a) a base that is attachable to the work surface;
(b) a socket on the base for receiving an electrical connector, the connector having an axial centerline and a plurality of apertures extending substantially parallel to the axial centerline, the socket including means for holding the connector in a predetermined position; and,
(c) means for allowing robotic determinations of the precise spatial orientation of the apertures in the connector both with respect to the rotational position of the connector about its axial centerline and with respect to rotation of the apertures of the connector about a line that is orthogonal to the axial centerline of the connector.

4. The connector block of claim 3 wherein the connector includes a keying mechanism, and wherein the socket member includes keying means, the keying means of the socket being configured to mate with the keying mechanism of the connector.

5. The connector block of claim 4 further including clocking adjustment means for selectively positioning the socket member into any one of a plurality of positions.

6. The connector block of claim 5 wherein the clocking adjustment means includes a locking pin, and a plurality of bores of differing depth in the socket for allowing selection of the position of the socket relative to the base.

7. The connector block of claim 6 wherein the socket includes twelve clocking positions arranged so that the depth change between adjacent bores is greater than one-twelfth the maximum bore depth.

8. The device of claim 6 wherein an exposed portion of the locking pin is light-reflective.

9. The device of claim 6 further comprising a reference pin on the base to define a reference plane for the robot, the plane being defined by the position of the reference pin and locking pin.

10. The device of claim 3 includes a reference pin and a locking pin, the locking pin being positionable within a preselected bore in the socket such that the height of the locking pin is indicative of the rotational orientation of the connector in the socket,

11. The device of claim 10 wherein the locking pin has a shoulder for seating on the bore of the socket, the length of the pin between the shoulder and the top end being precisely machined to a predetermined value.

12. The device of claim 11 wherein the socket includes a plurality of bores extending inwardly to differing depths.

13. A connector block, comprising:

(a) a base;

(b) a socket connectable to the base, the socket having a longitudinal axis and being capable of receiving an electrical connector in a predetermined orientation which includes predetermined rotation of the connector about the longitudinal axis of the socket; and (c) means for identifying by a robot the orientation of the socket and connector relative to the base, including:

(i) means for identifying the orientation of the longitudinal axis in space; and, (ii) means for identifying the orientation of the connector relative to its rotation about the longitudinal axis.

14. The connector block of claim 13 wherein the means for identifying the longitudinal axis includes at least two pins positioned with the axial centerlines of the pins being coplanar with the longitudinal axis.

15. The connector block of claim 14 wherein the means for identifying the orientation of the connector about the longitudinal axis includes means for positioning at least one of the pins at a position indicative of the orientation of the connector relative to the rotation about the longitudinal axis.

16. The connector block of claim 14 wherein the socket includes a plurality of radially extending circumferentially spaced apart bores, the depth of each bore being different from the depth of each other bore; the bores being positioned in the socket to allow insertion of one of the pins and thereby establish the rotational position of the socket with the pin received in the bore projecting beyond the base by a distance that is indicative of the rotational orientation of the connector.

17. The connector block of claim 16 wherein the socket includes 12 radially extending bores that are circumferentially spaced apart by an equal amount.

18. The connector block of claim 16 wherein each of the pins includes a light-reflective region for optical determination of the plane including the longitudinal axis of the socket.

* * * * *